US007216864B2

(12) United States Patent
Yoshihara

(10) Patent No.: US 7,216,864 B2
(45) Date of Patent: May 15, 2007

(54) PAPER SUPPLY CASSETTE FOR AN IMAGE FORMING DEVICE

(75) Inventor: Hideo Yoshihara, Dongguan (CN)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 20 days.

(21) Appl. No.: 10/653,362

(22) Filed: Aug. 28, 2003

(65) Prior Publication Data

US 2004/0041334 A1 Mar. 4, 2004

(30) Foreign Application Priority Data

Aug. 30, 2002 (JP) ..... 2002-254413

(51) Int. Cl.
*B65H 1/00* (2006.01)

(52) U.S. Cl. ..... 271/145; 271/162

(58) Field of Classification Search ..... 271/121, 271/145, 160, 162, 164, 167, 9.11; 15/1.51, 15/3, 102; 347/155, 264, 104; 399/390
See application file for complete search history.

(56) References Cited

U.S. PATENT DOCUMENTS 4,370,050 A * 1/1983 Matsui et al. ..... 399/99
4,732,430 A * 3/1988 Byrns ..... 312/330.1
5,013,106 A * 5/1991 Twellmann ..... 312/330.1
5,211,760 A * 5/1993 Kedarnath ..... 134/1
5,374,047 A * 12/1994 Tsukamoto et al. ..... 271/10.01
5,375,923 A * 12/1994 Hall et al. ..... 312/348.4
5,419,544 A 5/1995 Ono et al.
5,611,528 A * 3/1997 Nakamura et al. ..... 271/164
5,918,875 A * 7/1999 Masley et al. ..... 271/162
6,049,346 A * 4/2000 Cho ..... 347/153
6,471,202 B1 * 10/2002 Sugimura ..... 271/10.11
2002/0050680 A1 * 5/2002 Yanagi et al. ..... 271/121
2002/0098013 A1 * 7/2002 Kamimura ..... 399/167

FOREIGN PATENT DOCUMENTS

JP A 59-133566 7/1984

(Continued)

OTHER PUBLICATIONS

Figures 1-13 showing photographs of an hp LaserJet 4200 printer and three pages of the owners manual for the hp LaserJet 4200 printer.*

(Continued)

*Primary Examiner*—Patrick Mackey
*Assistant Examiner*—Thomas Morrison
(74) *Attorney, Agent, or Firm*—Oliff & Berridge, PLC

(57) ABSTRACT

A paper supply cassette includes a separately formed case, accommodating unit cover, and handle part. A separating mechanism for separating and conveying paper stacked in the case one sheet at a time is supported in a support unit provided on the front side surface of the case. Generally, high precision is required when mounting the separating mechanism into the paper supply cassette, and the separating mechanism must be demonstrated to have sufficient separating performance prior to shipping the product. When modifications are made to the design of the laser printer, it is possible to reuse the case while replacing the handle part with a new part, thereby eliminating the time and effort required to redesign the separating mechanism and to demonstrate its separating performance.

38 Claims, 10 Drawing Sheets

FOREIGN PATENT DOCUMENTS

| | | | |
|---|---|---|---|
| JP | 59-203016 | * | 11/1984 |
| JP | 59-203017 | * | 11/1984 |
| JP | 63-71038 | * | 3/1988 |
| JP | 63-71043 | * | 3/1988 |
| JP | A 03-042436 | | 2/1991 |
| JP | 3-61232 | * | 3/1991 |
| JP | 3-98920 | * | 4/1991 |
| JP | 4-153130 | * | 5/1992 |
| JP | 4-153136 | * | 5/1992 |
| JP | 5-132172 | * | 5/1993 |
| JP | 5-186077 | * | 7/1993 |
| JP | 6-211363 | * | 8/1994 |
| JP | 8-59008 | * | 3/1996 |
| JP | A 10-7267 | | 1/1998 |
| JP | S63-135830 | | 9/1998 |
| JP | A 11-116080 | | 4/1999 |
| JP | A 11-314781 | | 11/1999 |
| JP | A 2000-025966 | | 1/2000 |

OTHER PUBLICATIONS

English absttract for Japanese Publication No. 4-153136, which was published on May 26, 1992.*

* cited by examiner

PAPER SUPPLY CASSETTE FOR AN IMAGE FORMING DEVICE

BACKGROUND OF THE INVENTION

1. Field of the Invention

The present invention relates to a paper supply cassette and an image forming device equipped with the paper supply cassette.

2. Description of the Related Art

Image forming devices, such as laser printers and copy machines, that are provided with a detachably mounted paper supply cassette are well known in the art. The paper supply cassette includes an integrally formed case and a handle part. The case can holds a stack of recording sheets. The handle part is formed as a decorative plate on the front surface of the paper supply cassette and is used by a user to grip the handle part when inserting or removing the paper supply cassette. A supporting part is provided between the integrally formed case and the handle part. The supporting part supports a separating unit, which functions to separate and convey the sheets from the stack in the paper supply cassette one sheet at time.

SUMMARY OF THE INVENTION

However, the separating unit must be precisely mounted in the paper supply cassette so that sheets can be precisely separated from the stack. To meet this requirement, the separating unit must be redesigned each time there is a change in the design of the paper supply cassette, and the separating performance of this separating unit must be demonstrated. Thus, a great amount of time and effort is required to manufacture a paper supply cassette having a separating unit with sufficient separating ability.

A sheet supply cassette according to the present invention holds recording sheets and that is used detachably mounted in an image forming device. The sheet supply cassette includes a case that holds a stack of recording sheets. The case has a separation portion that separates recording sheets from the stack of recording sheets, and a receiving portion that receives the separation portion. The sheet supply cassette also includes a handle part provided as a separate member from the case. The handle part is fixed to the case and has a handle for pulling the case. The case has a handle-part-side end that is adjacent to the handle part and the receiving portion is located at the handle-part-side end.

DETAILED DESCRIPTION OF THE EMBODIMENT

Figure 1:
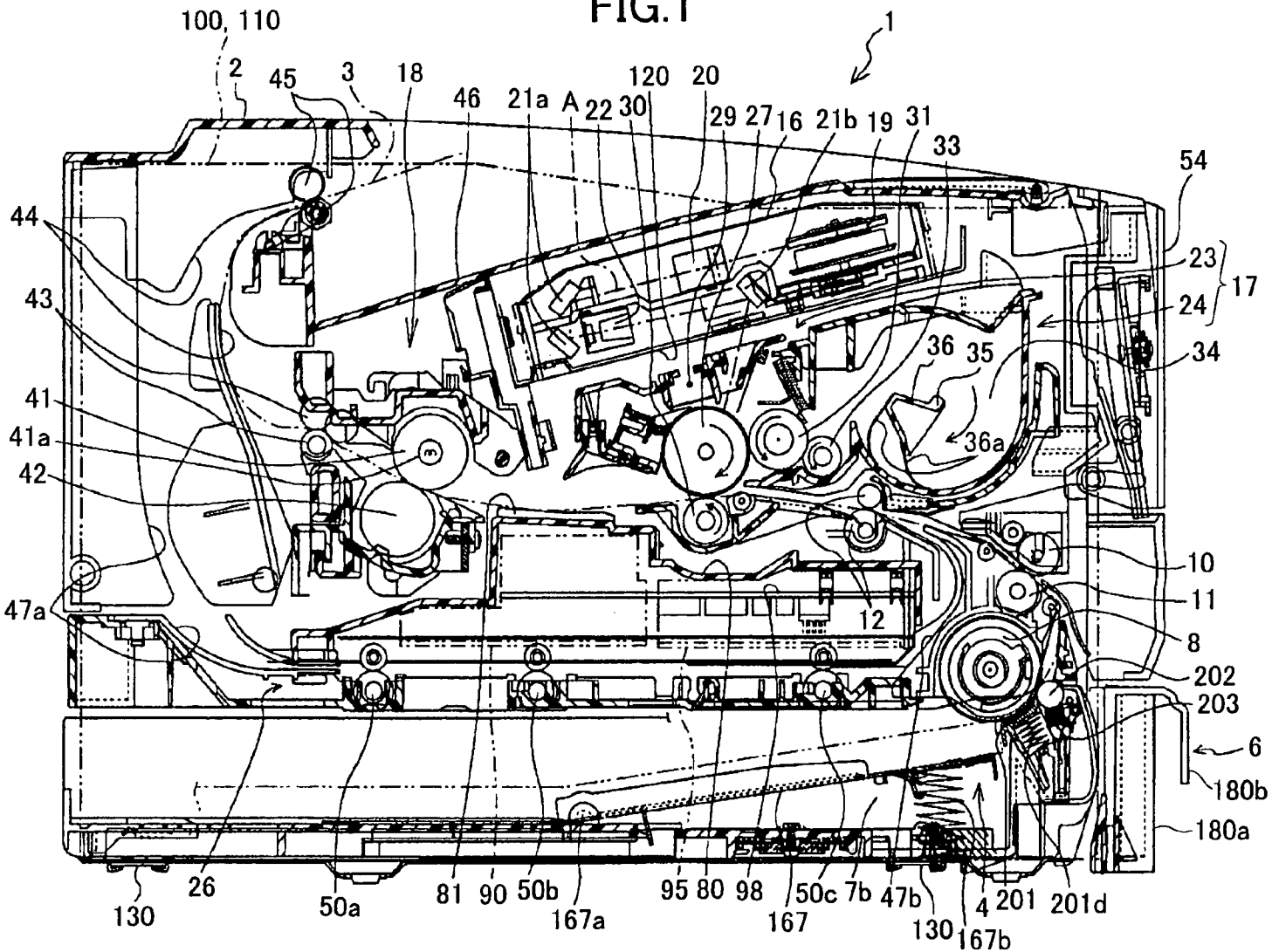
FIG. 1 is a central cross-sectional view showing a laser printer according to an embodiment of the present invention.

A laser printer 1 according to an embodiment of the present invention will be described with reference to the accompanying drawings. First, overall structure of the laser printer 1 will be described with reference to FIG. 1. FIG. 1 is a central sectional view of the laser printer 1.

As shown in cross-section in FIG. 1, the laser printer 1 includes a feeder section 4, and an image forming section, all accommodated in a main body case 2. The feeder section 4 is for feeding sheets 3. The image forming section is for forming imaged on each fed sheet 3, and includes a scanner unit 16, a process cartridge 17, and a fixing unit 18. Note that the right side of FIG. 1 is the front surface of the laser printer 1.

A sheet delivery tray 46 is formed as an upwardly slanting recess located at the upper center surface of the main case body 2. Printed sheets 3 are discharged from the laser printer 1 into a stack on the tray 46. A space that holds a process cartridge 17 is provided in a portion close to the front upper surface of the main body case 2. The space is open to the front side so the process cartridge 17 can be inserted. A cover 54 that pivots downward is provided on a right end side (front side) of the main body case 2. The cover 54 is for covering the space. A process cartridge 17 is inserted and removed where the cover 54 is opened widely.

A sheet delivery path 44 is provided at the rear part in the main body case 2 (left side in FIG. 1). The sheet delivery path 44 is formed in a semi-arc shape that extends vertically along the back of the main body case 2. The sheet delivery path 44 delivers the sheet 3 from a fixing device 18, which is provided on a rear end side in a lower part of the main body case 2, to the sheet delivery tray 46, which is provided on an upper part of the main body case 2. A sheet delivery roller 45 for conveying the sheet 3 is provided along the sheet delivery path 44.

The feeder unit 4 includes a paper supply cassette 6, a feed roller 8, a conveying roller 11, a paper dust removing roller 10, and register rollers 12. The paper supply cassette 6 is for holding stacked sheets 3 and is detachably mounted in the bottom section of the main casing 2. The paper supply cassette 6 can be inserted through the front face of the laser printer 1 by moving in a front-to-back direction and removed from the laser printer 1 by moving in a back-to-front direction. The feed roller 8 is disposed in the lower section of the main casing 2 for picking up and feeding a sheet of the sheet 3 from the paper supply cassette 6. The conveying roller 11 is disposed downstream from the feed roller 8 in the direction for conveying the sheet 3. The paper dust removing roller 10 presses against the conveying roller 11 with the sheet 3 interposed therebetween and removes paper dust from the sheet 3 while conveying the sheet 3 in cooperation with the conveying roller 11. The register rollers 12 are provided downstream from the conveying roller 11 in the conveying direction of the sheet 3 for regulating the timing at which the sheet 3 is fed for printing.

Next, the duplex printing unit 26 will be described. The duplex printing unit 26 is disposed above the paper supply cassette 6 and includes reverse conveying rollers 50*a*, 50*b*, and 50*c* arranged in a substantially horizontal orientation. A reverse conveying path 47*a* is provided on the rear side of the reverse conveying roller 50*a* and a reverse conveying path 47*b* is provided on the front side of the reverse conveying roller 50*c*. The reverse conveying path 47*a* extends from the discharge roller 45 to the reverse conveying rollers 50*a* and branches from the discharge path 44 near the end of the discharge path 44 with respect to the sheet feed direction of the sheet 3. The reverse conveying path 47*b*, on the other hand, extends from the reverse conveying roller 50*c* to the register rollers 12.

When performing duplex printing, first an image is formed on one side of the sheet 3. Then a portion of the sheet 3 is discharged onto the discharge tray 46. When the trailing edge of the sheet 3 becomes interposed between the discharge rollers 45, the discharge rollers 45 stop rotating forward and begin rotating in reverse. At this time, the trailing edge of the sheet 3 contacts the arched surface of the discharge path 44 and is guided along the arched surface to the reverse conveying path 47*a*, without returning to the discharge path 44. The sheet 3 is conveyed from the reverse conveying path 47*a* to the reverse conveying rollers 50*a*, 50*b*, and 50*c* and is subsequently guided to the register rollers 12 along the reverse conveying path 47*b*. According to this operation, the sheet 3 is conveyed to the image forming unit with its front and back surfaces switched in order to form an image on the other side of the sheet 3.

A low-voltage power source circuit board 90, the high-voltage power source circuit board 95, and an engine circuit board 98 are provided between the duplex printing unit 26 and the image forming unit. A chute 80 is disposed between these circuit boards 90, 95, and 98 and the image forming unit for separating these circuit boards 90, 95, 98 from the fixing unit 18, the processing cartridge 17, and other devices. The chute 80 is formed of a synthetic resin and spans between left and right frames 100 and 110 that are provided in the laser printer 1 to support such devices as the scanning unit 16 and fixing unit 18. A guiding plate 81 is provided on the top of the chute 80 for guiding the sheet 3. The guiding plate 81 forms a portion of the conveying path for the sheet 3. In addition to the chute 80, a steel tray 120 on which the scanning unit 16 is fixed spans between the frames 100 and 110 above the chute 80 and two underbars 130 span between the frames 100 and 110 below the chute 80. The underbars 130 are reinforced by folding back both lengthwise steel edges of the elongated steel plate toward the center of the plate surface.

The low-voltage power source circuit board 90 functions to drop the voltage supplied from a source external to the laser printer 1, such as a single-phase 100V source, to a voltage of 24V, for example, to be supplied to components in the laser printer 1. The high-voltage power source circuit board 95 generates a high-voltage bias that is applied to components in the processing cartridge 17. The engine circuit board 98 drives a DC motor (not shown), a solenoid (not shown), a laser emitting section (not shown), and the like. The DC motor is the source for driving parts involved in mechanical operations, such as the rollers in the laser printer 1. The solenoid (not shown) is for switching the operating direction of this drive system.

The scanner unit 16 of the image forming section includes a laser beam emitting section (not shown), a polygon mirror 19, a fθ lens 20, reflecting mirrors 21*a*, 21*b*, and a relay lens 22. The laser beam emitting section is located right below the sheet delivery tray 46 of the main body case 2 and irradiates a laser beam. The polygon mirror 19 rotates to scan the laser beam from the laser beam emitting section in a main scanning direction across the surface of a photosensitive drum 27. The fθ lens 20 is for stabilizing scanning speed of the laser beam reflected from the polygon mirror 19. The reflecting mirrors 21*a*, 21*b* are for reflecting the laser beam. The relay lens 22 is for adjusting the focal position in order to focus the laser beam from the reflecting mirror 21 onto the photosensitive drum 27. With this configuration, the laser beam is irradiated from the laser beam emitting section based upon predetermined image data and passes through or is reflected by the polygon mirror 19, the fθ lens 20*a*, the reflecting mirror 21, the relay lens 22 and the fθ lens 20*b* in this order as indicated by an alternate long and dash lines A in FIG. 1 to expose and scan the surface of the photosensitive drum 27 of the process cartridge 17.

The fixing device 18 in the image forming section is disposed downstream from the process cartridge 17 with respect to the direction of sheet transport. The fixing device 18 in the image forming section includes a heating roller 41, a pressing roller 42 for pressing the heating roller 41, and a pair of conveying rollers 43. The conveying rollers 43 are provided downstream from the heating roller 41 and the pressing roller 42. The heating roller 41 is formed by coating a hollow aluminum roller with a fluorocarbon resin and sintering the assembly. The heating roller 41 includes a metal tube and a halogen lamp for heating inside the metal tube. The pressing roller 42 includes a silicon rubber shaft having low hardness that is covered by a tube formed of a fluorocarbon resin. The silicon rubber shaft is urged upward by a spring (not shown), pressing the pressing roller 42 against the heating roller 41. While the sheet 3 from the process cartridge 17 passes between the heating roller 41 and the pressing roller 42, the heating roller 41 pressurizes and heats toner that was transferred onto the sheet 3 in the process cartridge 17, thereby fixing the toner onto the sheet 3. Afterward, the sheet 3 is transported to the sheet delivery path 44 by the conveying rollers 43.

The process cartridge 17 includes a drum cartridge 23 and a developing cartridge 24 that is detachably mounted on the drum cartridge 23. The drum cartridge 23 includes the photosensitive drum 27, a Scorotron charger 29, and a transfer roller 30. The developing cartridge 24 includes a developing roller 31, a supply roller 33, and a toner hopper 34.

The photosensitive drum 27 is arranged in the drum cartridge 23 so as to contact the developing roller 31. The photosensitive drum 27 is rotatable clockwise as indicated by the arrow in FIG. 1. The photosensitive drum 27 includes positively charging organic photo conductor coated on a conductive base material. The positively charging organic photo conductor is made from a charge transfer layer dispersed with a charge generation material. When the photosensitive drum 27 is exposed by a laser beam, the charge generation material absorbs the light and generates a charge. The charge is transferred onto the surface of the photosensitive drum 27 and the conductive base material through the charge transfer layer and counteracts the surface potential charged by the Scorotron charger 29. As a result, a potential difference is generated between regions of the photosensitive drum 27 that were exposed and regions that were not exposed by the laser light. By selectively exposing and scanning the surface of the photosensitive drum 27 with a laser beam based upon image data, an electrostatic latent image is formed on the photosensitive drum 27.

The Scorotron charger 29 is disposed above the photosensitive drum 27. The Scorotron charger 29 is separated from and out of contact with the photosensitive drum 27 by a predetermined distance. The Scorotron charger 29 generates a corona discharge from a wire made from tungsten, for example, and is turned ON by a charging bias circuit unit (not shown) of the high-voltage power source 95 to positively charging the surface of the photosensitive drum 27 to a uniform charge of positive polarity.

The developing roller 31 is disposed further downstream than the Scorotron charger 29 with respect to the rotation direction of the photosensitive drum 27, that is the clockwise direction as viewed in FIG. 1. The developing roller 31 is rotatable counterclockwise as indicated by an arrow in FIG. 1. The developing roller 31 includes a roller shaft made from metal covered with a roller made from a conductive rubber material. A development bias is applied to the developing roller 31 from a development bias circuit unit (not shown) of the high-voltage power source 95.

The supply roller 33 is rotatably disposed beside the developing roller 31 on the opposite side from the photosensitive drum 27 across the developing roller 31. The supply roller 33 is in pressed contact with the developing roller 31. The supply roller 33 includes a roller shaft made of metal coated with a roller made of a conductive foam material and is adapted to triboelectrify toner supplied to the developing roller 31. Furthermore, the supply roller 33 is rotatable counterclockwise as indicated by an arrow in FIG. 1. This is the same rotation direction as developing roller 31.

The toner hopper 34 is provided beside the supply roller 33. The inside of the toner hopper 39 is filled with developer to be supplied to the developing roller 31 by the supply roller 33. In this embodiment, non-magnetic, single-component toner with a positive charging nature is used as a developer. The toner is a polymeric toner obtained by copolymerizing polymeric monomers using a well-known polymerization method such as suspension polymerization.

Examples of polymeric monomers include styrene monomers and acrylic monomers. Styrene is an example of a styrene monomer.

Examples of acrylic monomers include acrylic acid, alkyl (C1 to C4) acrylate, and alkyl (C1 to C4) methacrylate. A coloring agent, such as carbon black, and wax are mixed in the polymeric toner. An externally added agent such as silica is also added in order to improve fluidity. Particle diameter of the polymeric toner is approximately 6 to 10 μm.

An agitator 36 is provided for agitating toner accommodated in the toner hopper 34 and supplying the toner into a developing chamber 37. The agitator 36 has a coarse mesh-like plate shape extending in the axial direction (near-to-far direction in FIG. 1) and has a bend in the middle when viewed as a cross-section. A rotating shaft 35 is disposed on one end of the agitator 36. Film members 36*a* for scraping the inner wall of the toner hopper 34 are provided on the other end of the agitator 36 and in the bend in the middle of the agitator 36. The rotating shaft 35 is rotatably supported in the center of both lengthwise ends of the toner hopper 34 and, hence, supports the agitator 36. When the agitator 36 is rotated in the direction indicated by the arrow, toner accommodated in the toner hopper 34 is agitated and supplied into the developing chamber 37.

The transfer roller 30 is disposed below the photosensitive drum 27 and downstream from the developing roller 31 with respect to the rotating direction of the photosensitive drum 27. The transfer roller 30 is rotatable counterclockwise as indicated by an arrow in FIG. 1. The transfer roller 30 includes a metal roller shaft coated with a roller made from an ion-conductive rubber material. During the transfer process, a transfer bias circuit unit (not shown) of the high-voltage power source 95 applies a transfer forward bias to the transfer roller 30. The transfer forward bias generates a potential difference between the surfaces of the photosensitive drum 27 and the transfer roller 30. The potential difference electrically attracts toner that electrostatically clings to the surface of the photosensitive drum 27 toward the surface of the transfer roller 30.

It should be noted that the laser printer 1 employs what is known as a cleanerless developing system, wherein the developing roller 31 recovers toner remaining on a surface of the photosensitive drum 27 after the transfer roller 30 transfers toner from the photosensitive drum 27 to the sheet 3.

Figure 2:
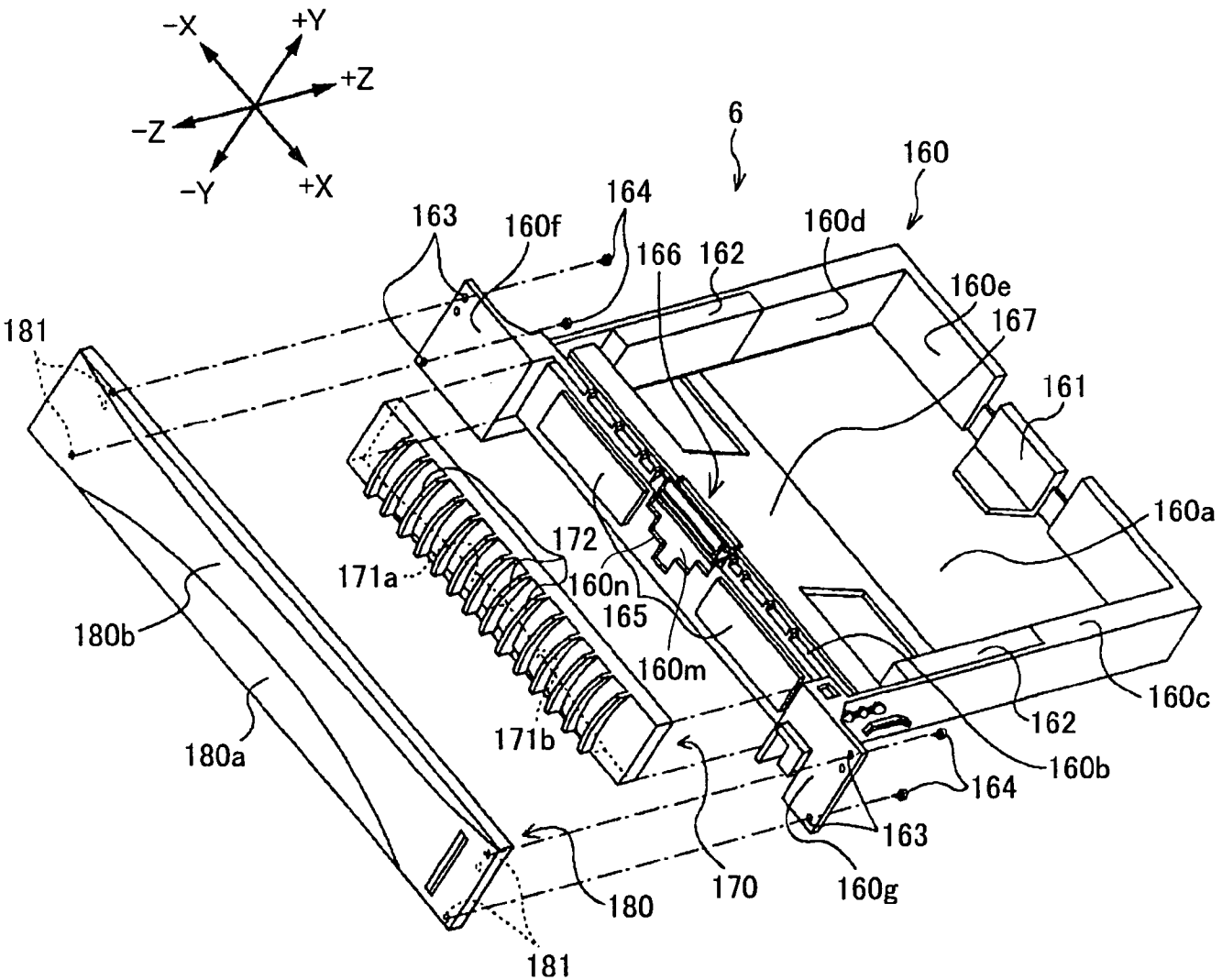
FIG. 2 is an exploded perspective view showing a paper supply cassette according to the embodiment.

Next, the structure of the paper supply cassette 6 will be described in detail with reference to FIGS. 2 through 9. FIGS. 2, 6, 7, 8, and 9 include direction arrows to indicate the orientation of the laser printer 1, wherein −Z direction, −X direction, +X direction, +Z direction, +Y direction, and −Y direction correspond to forward, leftward, rightward, backward, up, and down, respectively. As shown in FIG. 2, the paper supply cassette 6 includes a case unit 160, an accommodating section cover 170, and the handle part 180.

The case unit 160 has an open-top box shape to hold stacked sheets 3. The case unit 160 includes a bottom plate 160*a* and side walls 160*b*, 160*c*, 160*d*, and 160*e*. The bottom plate 160*a* have a substantially rectangular shape and a surface area slightly larger than that of the sheet 3. The side walls 160*b*, 160*c*, 160*d*, and 160*e* extend from the four edges of the bottom plate 160*a* in the +Y direction, which is a direction perpendicular to the surface of the bottom plate 160*a*. Each of these side walls 160*b*, 160*c*, 160*d*, and 160*e* are connected with adjacent side walls at the corners of the bottom plate 160*a*, forming the open-top box shape. The case unit 160 is formed of a synthetic resin material. A guide plate 161 and a pair of guide plates 162 are provided on the bottom plate 160*a* for maintaining the alignment of the stacked sheets 3. The surfaces of the guide plates 162 are flush with the surfaces of the side walls 160*d* and 160*c*. The guide plate 161 can move in the Z directions (front and rear directions of the case unit 160) and the guide plates 162 can move in the X directions (left and right directions). Hence, different sizes of the sheet 3 can be maintained in alignment depending on the intended usage.

Figure 7:
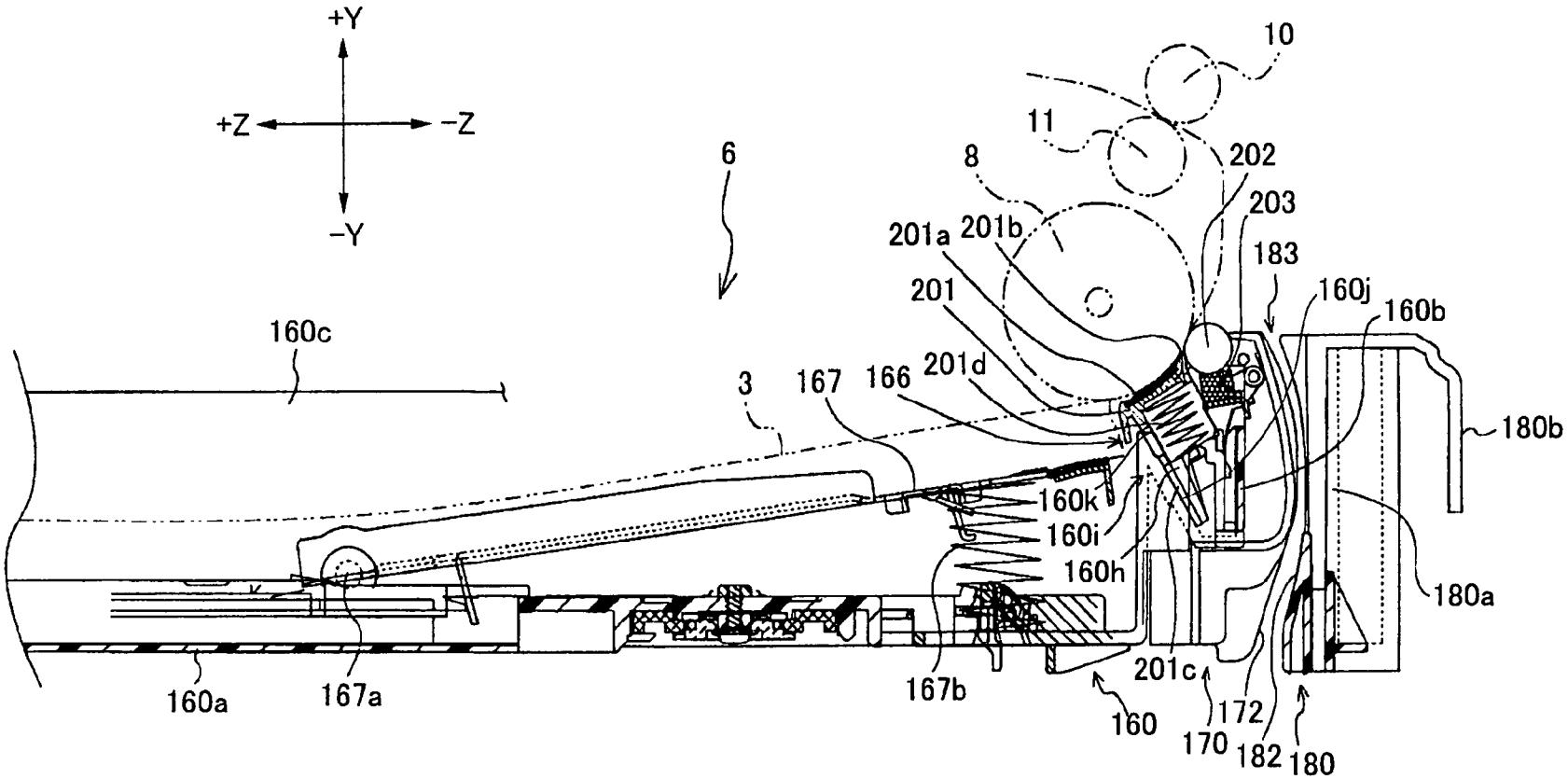
FIG. 7 is a cross-sectional view showing essential components of the paper supply cassette.
Figure 8:
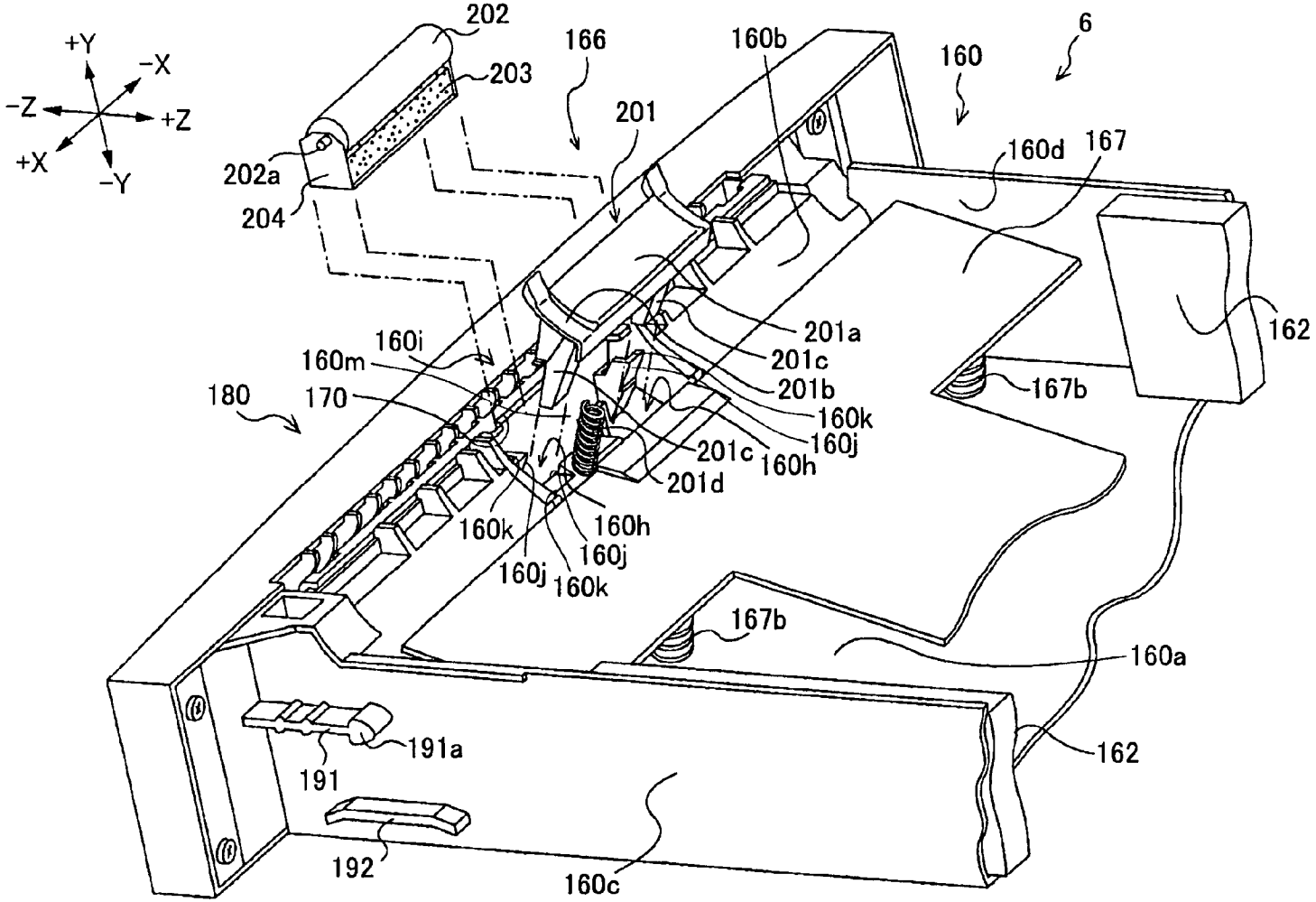
FIG. 8 is a perspective view showing the area of the paper supply cassette around a sheet separating portion.

A paper pressing plate 167 is disposed in the bottom plate 160*a* for pressing the stacked sheets 3 toward the feed roller 8 when the paper supply cassette 6 is mounted in the laser printer 1. As shown in FIG. 8, the paper pressing plate 167 is a flat steel plate shaped substantially like an H as can be seen in FIG. 2. As shown in FIG. 7, a support shaft 167*a* provided on the end of the paper pressing plate 167 farthest from the feed roller 8 supports the paper pressing plate 167 near the center of the bottom plate 160*a*. The end of the paper pressing plate 167 nearest to the feed roller 8 is capable of moving in a vertical direction as the paper pressing plate 167 rotates about the support shaft 167*a*. A spring 167*b* is disposed on the underside of the paper pressing plate 167 for urging the paper pressing plate 167 toward the feed roller 8. As the number of sheets of the sheet 3 stacked on the paper pressing plate 167 increases, the paper pressing plate 167 pivots about the support shaft 167*a* downward against the urging force of the spring 167*b* by an amount that corresponds to the amount of sheets.

As shown in FIG. 2, an opening 160*m* is formed through the side wall 160*b* of the case unit 160 at a location substantially center in the widthwise direction (X directions). The opening 160*m* is defined by a side-wall-opening edge 160*n*. When the accommodating section cover 170 is fitted to the side wall 160*b*, a central part of the accommodating section cover 170 covers the opening 160*m*.

Protruding ends 160*f* and 160*g* are provided on the front side wall 160*b* of the case unit 160. The protruding ends 160*f* and 160*g* are fixing members that extend following the plane of the front side wall 160*b* from either end in the X directions (left and right directions). Two screw holes 163 are formed in the outer edge of each of the protruding ends 160*f* and 160*g*. The handle part 180 is fixed onto the protruding ends 160*f* and 160*g* by inserting screws 164 into the screw holes 163. Vibration absorbing members 165 are fixed on the side wall 160*b* so as to face outward from the case unit 160, that is, in the −Z direction. The vibration absorbing members 165 absorb vibrations generated by driving in the laser printer 1 that are transferred to the paper supply cassette 6, thereby reducing vibration and noise generated by resonance in the paper supply cassette 6. A separation portion 166 is also disposed on the side wall 160*b* at a position above the opening 160*m*. The separation portion 166 is for separating and conveying the sheet 3 accommodated in the case unit 160 to be printed one sheet at a time. The separation portion 166 will be described in more detail later.

The accommodating section cover 170 is formed from a synthetic resin and is fixed to the side wall 160*b* by snapping the accommodating section cover 170 in place between the protruding ends 160*f* and 160*g*. Hence, the accommodating section cover 170 covers the surface on which the vibration absorbing members 165 are provided, but does not cover the protruding ends 160*f* and 160*g*, and forms an enclosed space therein. Slanted surfaces 171*a* and 171*b* are formed on the inner surface of the accommodating section cover 170. The slanted surfaces 171*a* and 171*b* slant, from approximately the center toward both ends of the accommodating section cover 170, downward in the −Y direction and outward in the X directions (left and right directions of the paper supply cassette 6). The enclosed space between the side wall 160*b* and the accommodating section cover 170 serves as a paper dust accommodating unit for collecting paper dust from the sheets of the sheet 3 that is generated by friction between the sheet 3 and a rubber pad 201*a* of the separation portion 166 (see FIG. 7).

Figure 3:
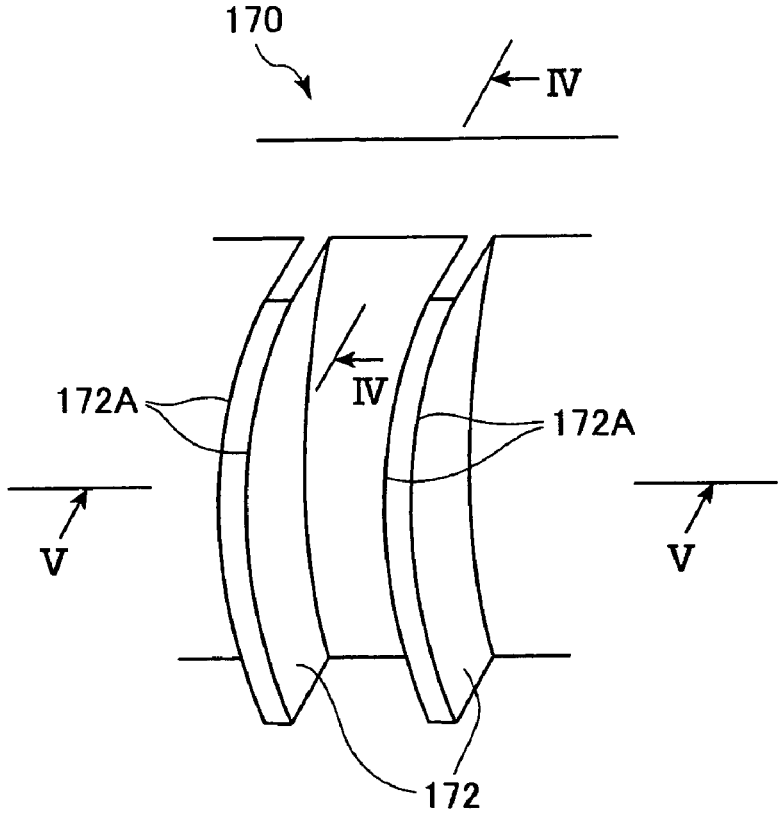
FIG. 3 is a perspective view showing details of a guide ribs for guiding sheets conveyed from a lower paper supply cassette to an image forming section.
Figure 4:
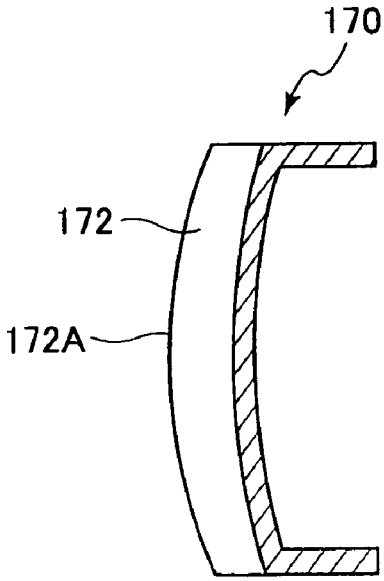
FIG. 4 is a view taken along line IV-IV of FIG. 3.
Figure 5:
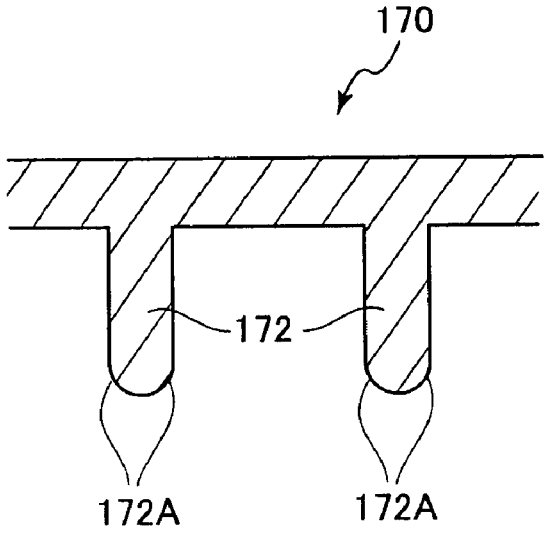
FIG. 5 is a view taken along line V-V of FIG. 3.

As shown in FIG. 2, a plurality of guiding ribs 172 extend in the Y direction along the outer surface of the accommodating section cover 170, that is, along the surface that is substantially parallel to the side wall 160*b* and that faces in a paper guiding side (−Z direction). Each guiding rib 172 arches, with respect to the Y directions, in the −Z direction as shown in FIGS. 4 and 7 and also in the −X direction as shown in FIG. 3. Each guiding rib 172 includes ridges 172A that extend in the direction in which sheets 3 are conveyed. As shown in FIG. 5, each ridge 172A is curved with respect to the direction perpendicular to the conveying direction so that the end of each guiding rib 172 has a substantial C-shape. In other words, each ridge 172A is formed with a curving surface that extends along the ridge 172A.

The handle part 180 is a decorative plate formed from a synthetic resin and covers the side wall 160*b* on which the accommodating section cover 170 is provided. The handle part 180 includes a plate surface 180*a* and a handle section 180*b*. The plate surface 180*a* is substantially flat and extends in the X and Y directions (left, right, up, down directions). The handle section 108*b* extends substantially parallel to the plate surface 180*a*, but as can be seen in FIG. 1 is positioned further outward in the Z direction than the plate surface 180*a*. The distance between the plate surface 180*a* and handle section 180*b* is set to about the thickness of a user's fingers, for example. As can be seen in FIG. 2, the handle section 180*b* is formed with an arched shape at its lower edge. The arched shape enables a user to more easily insert his or her fingers in between the plate surface 180*a* and the handle section 180*b*.

Figure 6:
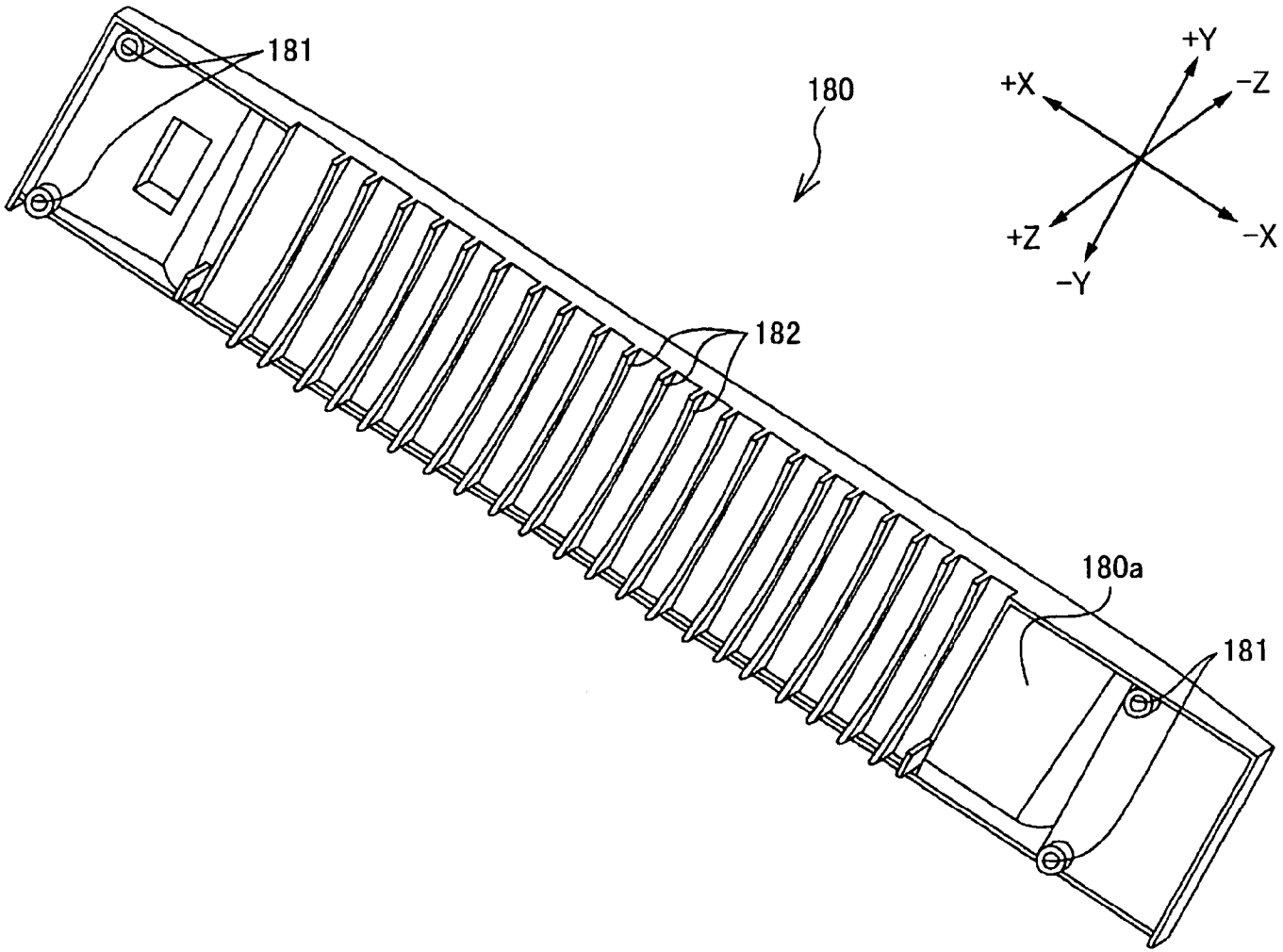
FIG. 6 is a perspective view showing a handle part on which guiding ribs are provided.

As shown in FIG. 6, the plate surface 180*a* is formed with screw receivers 181 for receiving the screws 164. Two screw receivers 181 are formed one each lengthwise end on the back surface of the plate surface 180*a*, that is, the surface facing in the +Z direction. The handle part 180 is fixed to the case unit 160 by inserting the screws 164 into the screw receivers 181 through the screw holes 163 formed in the protruding ends 160*f* and 160*g* shown in FIG. 2.

Guiding ribs 182 are provided on the back surface of the plate surface 180*a*. The guiding ribs 182 extend in the Y directions following the shorter dimension of the plate surface 180*a*. The guiding ribs 182 have a concave arched shape that corresponds to outward-protruding arched shape of the guiding ribs 172. The ridge portions of the guiding ribs 182 are formed with a curved surface similar to ridges portions of the guiding ribs 172. The guiding ribs 182 are disposed in confrontation with the guiding ribs 172 provided on the accommodating section cover 170 with a prescribed distance maintained between corresponding ones of the guiding ribs 182 and the guiding ribs 172. Therefore, as shown in FIG. 7, a paper conveying path 183 is formed between the guiding ribs 172 and the guiding ribs 182. When the laser printer 1 includes two or more paper supply cassettes, 6, the paper conveying path 183 serves as a path for guiding paper conveyed from the lower paper supply cassette, positioned below the upper paper supply cassette in FIG. 10, toward the image forming unit. In this case, another feeder unit 4 is provided for the lower paper supply cassette. The other feeder unit 4 serves as a sheet conveyor unit for conveying sheets from the lower paper supply cassette, through the paper conveying path 183 (shown in FIG. 7), toward the image forming unit. Paper can be conveyed smoothly through the paper conveying path 183 because the guiding ribs 172 and the guiding ribs 182 contact the leading edge of the paper with only a small surface area, which offers little frictional resistance to the paper.

As shown in FIG. 2, the case unit 160, the accommodating section cover 170, and the handle part 180 of the paper supply cassette 6 are all formed as separate members from each other. Each is formed by an injection molding process. The bottom plate 160*a* and the side walls 160*b*, 160*c*, 160*d*, and 160*e* are formed in a single injection molding process to form the case unit 160. Accordingly, the molds for forming each part can be manufactured separately. Therefore, the parting lines where the molds divide can be designed separately for the case unit 160, the accommodating section cover 170, and the handle part 180. Accordingly, the molds can be produced with a larger draft angle, thus allowing the product to be released from the mold during production without deforming. Further, the ridges of the guiding ribs 172 and guiding ribs 182 can be easily formed in the curved shape.

Figure 9:
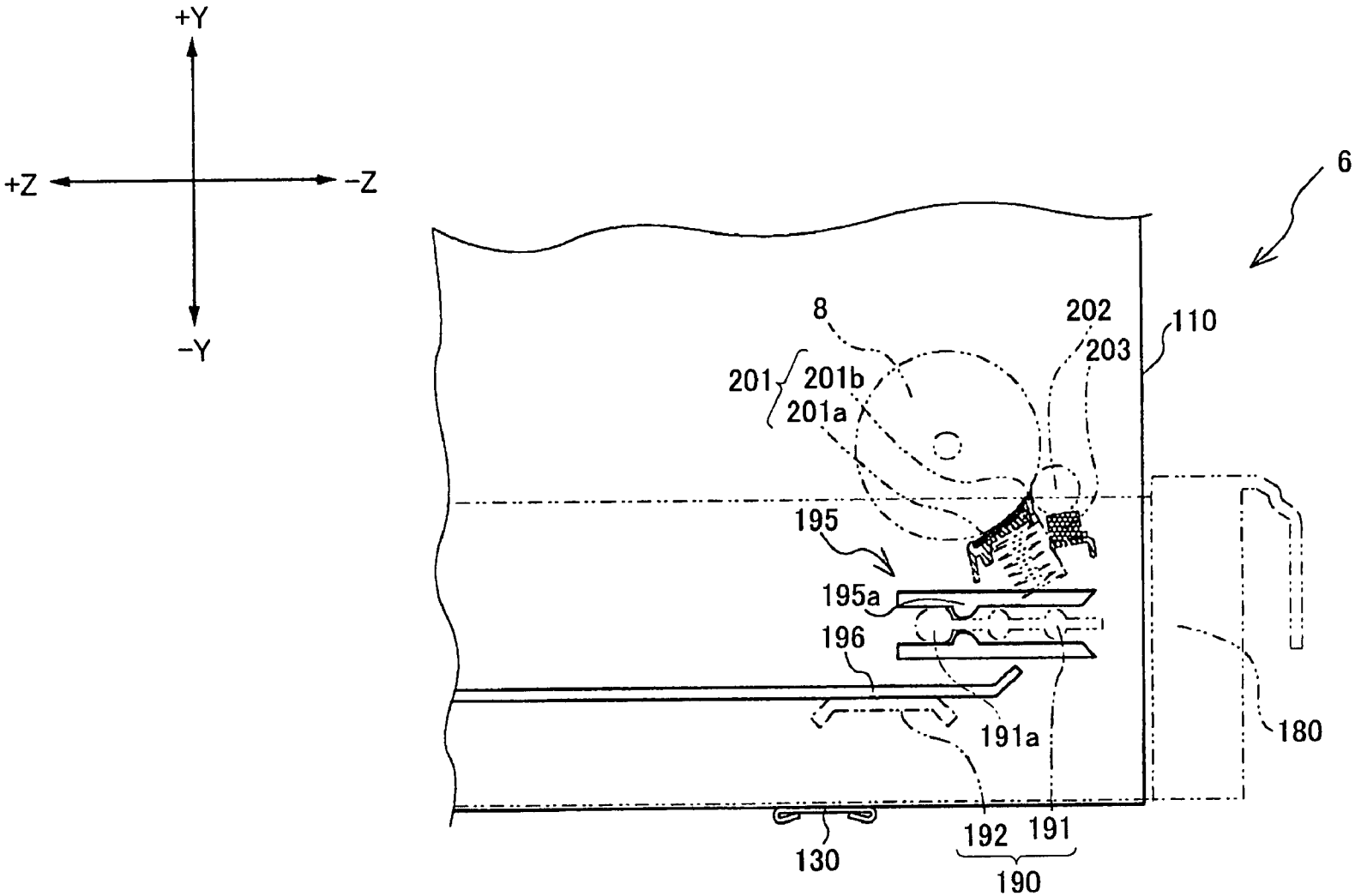
FIG. 9 is a side view in partial phantom showing the positional relationship between the paper supply cassette and a right frame of the laser printer when the paper supply cassette is mounted in the laser printer.

Next, the separation portion 166 and a receiving portion 160*i* for receiving the separation portion 166 will be described with reference to FIGS. 8 and 9. FIG. 8 is an enlarged perspective view showing the area of the paper supply cassette 6 around the separation portion 166. The separation portion 166 includes the separating pad 201 and a spring 201*d*. The separating pad 201 is for separating the sheet 3 one sheet at a time in cooperation with the feed roller 8, which is for feeding out the sheet 3. The spring 201*d* is for pressing the separating pad 201 toward the feed roller 8 when the paper supply cassette 6 is mounted in the laser printer 1.

The separating pad 201 is formed from a synthetic resin and, as shown in FIG. 8, includes a support plate 201*b* and two guide members 201*c*. The support plate 201*b* is substantially rectangular in shape as shown in FIG. 8 and curved to follow the outer surface of the feed roller 8 as shown in FIG. 7. The two guide members 201*c* are shaped like poles protruding from the support plate 201*b* near the lengthwise ends of the support plate 201*b* and extend in a direction substantially orthogonal to the surface of the support plate 201*b*. A rubber pad 201*a* is fixed to the top of the support plate 201*b*.

The receiving portion 160*i* is located at the end of the case unit 160 that is adjacent to the handle part 180.

More specifically, the receiving portion 160*i* is provided in approximately the widthwise (X directions) center. The receiving portion 160*i* includes guide wall portions 160*j*, support wall portions 160*k*, and the opening 160*m*.

The guide wall portions 160*j* and the support wall portions 160*k* are located near the side-wall-opening edge 160*n*. The guide wall portions 160*j* and the support wall portions 160*k* are formed integrally with the side wall 160*b* of the case unit 160. The guide wall portions 160*j* are provided at two locations corresponding to the guide members 201*c*. The opening 160*m* includes holding sections (openings) 160*h* for holding the guide members 201*c*. More specifically, the holding sections 160*h* are defined by the guide wall portions 160*j*. The support wall portions 160*k* are provided integrally with the guide wall portions 160*j* and face upward (+Y direction). The guide members 201*c* can be inserted into or withdrawn from the holding sections 160*h* following the direction in which the guide members 201*c* protrude. The spring 201*d* is disposed between the holding sections 160*h* and presses the rubber pad 201*a* on the surface of the separating pad 201 toward the feed roller 8.

As shown in FIG. 7, the guide wall portions 160*j* restrict the direction in which the guide members 201*c* can be inserted or withdrawn to a single direction. As a result, play of the guide members 201*c* is reduced and the surface of the rubber pad 201*a* always contacts the peripheral surface of the feed roller 8 at the same prescribed angle. When the guide members 201*c* moves downward and contact the support wall portions 160*k*, the support wall portions 160*k* prohibit further movement of the guide members 201*c*, thereby preventing the separating pad 201 from dropping through the opening 160*m* With this construction, the guide wall portions 160*j* and the support wall portions 160*k* support the separation portion 166 with restricted movement so that the separation portion 166 separates sheets from the stacked sheet 3 one sheet at a time with great precision.

As shown in FIGS. 7 and 8, a paper dust removing roller 202 and a sponge 203 are provided downstream in the paper conveying direction from the separating pad 201. The paper dust removing roller 202 and the sponge 203 are located between the separating pad 201 and the accommodating section cover 170 that covers the opening 160*m*. The peripheral surface of the paper dust removing roller 202 electrostatically attracts paper dust that is generated by friction between sheet 3 and the separating pad 201 as the sheet 3 is conveyed. The sponge 203 rubs against the outer surface of the paper dust removing roller 202 to tribocharge the paper dust removing roller 202 and scrapes off paper dust that has been deposited on the peripheral surface thereof. The paper dust removing roller 202 is formed from fluoroplastic, for example. A metal plate 204 includes an elongated plate surface and two lengthwise ends. The lengthwise ends are folded to extend in a direction orthogonal to the plate surface. The sponge 203 is fixed on the plate surface of the metal plate 204. A shaft 202*a* of the paper dust removing roller 202 is rotatably supported on the folded lengthwise ends of the metal plate 204, such that the peripheral surface of the paper dust removing roller 202 is maintained in contact with the sponge 203.

The metal plate 204 is supported in the side wall 160*b* at a position in the −Z direction from the separating pad 201, that is, downstream in the conveying direction of the sheet 3. The metal plate 204 is supported also by other support wall portion (not shown) provided to the side wall 160*b*. A spring (not shown) is disposed beneath the metal plate 204 to urge the paper dust removing roller 202 to press against the feed roller 8 as shown in FIG. 7. As mentioned previously, a paper dust accommodating unit is constructed by the space between the side wall 160*b* and the accommodating section cover 170. The paper dust accommodating unit is open only where the separation portion 166 and the paper dust removing roller 202 and sponge 203 are fixed to the side wall 160*b*.

Next, a mechanism for positioning the paper supply cassette 6 in the left and right frames 100 and 110 will be described with reference to FIGS. 1, 8, and 9. FIG. 9 shows the positional relationship of the paper supply cassette 6 and the right frame 110 when the paper supply cassette 6 is mounted in the laser printer 1. Because both the left frame 100 and the right frame 110 have the same positioning construction, description of the left frame 100 has been omitted.

As shown in FIG. 8, a guide member 192 and a positioning piece 191 are provided on the side wall 160*c* on the right of the paper supply cassette 6. The guide member 192 protrudes from the side wall 160*c* at a position near the handle part 180 in the lengthwise direction and near the bottom plate 160*a* in the height direction. The guide member 192 extends exactly a prescribed distance in the Z direction, which is parallel to the mounting direction of the paper supply cassette 6. Both lengthwise ends of the guide member 192 slant downward toward the bottom plate 160*a*. Although not shown in the drawings, another guide member 192 is provided on the opposite lengthwise end of the side wall 160*c*.

The positioning piece 191 protrudes from the side wall 160*c* and is located nearer to the handle part 180, and farther from the bottom plate 160*a*, than is the guide member 192. As with the guide member 192, the positioning piece 191 extends exactly a prescribed distance in the direction parallel to the mounting direction of the paper supply cassette 6. The guide member 192 has a lock part 191*a* that is slightly thicker than the other portions of the positioning piece 191. Two ribs are provided near the center of the positioning piece 191. The ribs serve as reinforcement for preventing the positioning piece 191 from collapsing. A positioning piece and guide members are also provided on the side wall 160*d* on the left side of the paper supply cassette 6.

As shown in FIG. 1, the paper supply cassette 6 is detachably mounted between the chute 80 and the underbars 130, which span between the left frame 100 and right frame 110. As shown in FIG. 9, a guide rail 196 and a positioning member 195 are provided on the inner surface of the right frame 110, that is, the surface that confronts the left frame 100.

The guide rail 196 is a rail-shaped protrusion that extends nearly the entire length of the right frame 110 in the Z directions (forward and rear directions). The two guide members 192 slidingly contact the guide rail 196, thus guiding the paper supply cassette 6, while the paper supply cassette 6 is mounted or removed.

The positioning member 195 includes upper and lower rail pieces for guiding the positioning piece 191 while the positioning piece 191 is interposed therebetween. Lock parts 195*a* protrude within the guiding groove between the two rails of the positioning member 195. The lock parts 195*a* apply resistance to movement of the lock part 191*a* in the Z directions and so engage the positioning piece 191 at a prescribed position. Although not shown in the drawings, a guide rail and positioning member are also provided on the left frame 100. Therefore, because the positioning member 195 maintains the paper supply cassette 6 at a prescribed position in the laser printer 1, the positional relationship between the feed roller 8 and the separating pad 201 remains uniform even after repeated mounting and removing of the paper supply cassette 6. This ensures that the stacked sheet 3 can be reliably separated one sheet at a time.

Next, the operations of the laser printer 1 during a printing process will be described with reference to FIGS. 1 and 7. The topmost sheet 3 of the stack on the pressing plate 167 is pressed against the feed roller 8 by the urging force of the spring 167*b*. A printing process begins when print data is received from a host computer (not shown). At the beginning of the printing process, the topmost sheet of the sheet 3 is conveyed between the feed roller 8 and rubber pad 201*a* by frictional force generated between the rotating feed roller 8 and the sheet 3. Because the rubber pad 201*a* always contacts the feed roller 8 at the same angle and with the same urging force from the spring 201*d*, the rubber pad 201*a* separates the sheets 3 with uniform precision, so that separated sheets 3 can be conveyed to the register rollers 12 one sheet at a time. That is, the separating pad 201 contacts the leading edge of the stacked sheets 3 (with respect to the direction of conveyance) at a prescribed angle of inclination and applies frictional force to the sheets 3. Those sheets 3 that do not receive conveying force from the feed roller 8 are held in place by the frictional force from the separating pad 201. Only the uppermost sheet 3 is transported because it is applied with the feed roller's conveyance force, which overcomes the friction is force of the rubber pad 201*a*.

As shown in FIG. 4, the underside surface of the sheet 3 rubs over the rubber pad 201*a* while the feed roller 8 is conveying the sheet 3. This generates paper dust. However, the paper dust removing roller 202 is charged by rubbing against the sponge 203 while the paper dust removing roller 202 rotates following rotation of the feed roller 8.

Therefore, the generated paper dust is electrostatically attracted to the paper dust removing roller 202. In addition, the sponge 203 scrapes the paper dust that was attracted to the paper dust removing roller 202 off from the paper dust removing roller 202. The paper dust enters the paper dust accommodating unit formed by the accommodating section cover 170 and the side wall 160*b* and is spread to the left and right sections of the paper dust accommodating unit by the slanted surface 711*a* and slanted surface 171*b* (see FIG. 2). Because paper dust is removed with this construction, it is possible to prevent disorders from occurring during an image forming process by the laser printer 1 caused by paper dust remaining on the sheet 3. Although a portion of the paper dust that is not completely removed by the paper dust removing roller 202 may be conveyed toward the image forming unit on the sheet 3, this paper dust is removed by the paper dust removing roller 10 disposed further downstream in the conveying direction.

The laser beam emitting section (not shown) of the scanner unit 16 generates a laser beam based upon a laser drive signal generated by an engine base plate 98. The laser beam falls incident on the polygon mirror 19. The polygon mirror 19 affords the laser beam with a scan movement in a main scanning direction (the direction perpendicular to the conveying direction of the sheet 3) while reflecting the laser beam toward the fθ lens 20. The fθ lens 20 converts the constant angular speed of the laser light from the polygon mirror 19 to a constant velocity scan. Then, the reflecting mirror 21*a* reflects the laser beam toward the lens 22, which converges the laser beam. The reflecting mirror 21*b* reflects the converged laser beam to focus on the surface of the photosensitive drum 27.

The Scorotron charger 29 charges the surface of the photosensitive drum 27 to a surface potential of, for example, approximately 1000 V. The laser beam from the scanner unit 16 scans across the surface of the photosensitive drum 27 in the main scan direction. The laser beam selectively exposes and does not expose the surface of the photosensitive drum 27 based on the laser drive signal described above. That is, portions of the surface of the photosensitive drum 27 that are to be developed are exposed by the laser light and portions that are not to be developed are not exposed. The surface potential of the photosensitive drum 27 decreases to, for example, approximately 100V at exposed portions, also referred to as bright parts. Because the photosensitive drum 27 rotates clockwise as indicated by an arrow in FIG. 1 at this time, the laser beam also exposes the photosensitive drum 27 in an auxiliary scanning direction, which is also the conveying direction of the sheet 3. As a result of the two scanning actions, an electrical invisible image, that is, an electrostatic latent image is formed on the surface of the photosensitive drum 27 from exposed areas and unexposed areas, which are also referred to as dark parts.

The agitator 36 supplies the toner in the toner hopper 34 to the development chamber 37 by rotation of the agitator 36. Then the supply roller 33 supplies the toner in the development chamber 37 to the developing roller 31 by rotation of the supply roller 33. At this time, the toner is triboelectrically charged to a positive charge between the supply roller 33 and the developing roller 31 and is regulated to a layer with constant thickness by a layer thickness control blade 32. A positive bias of, for example, approximately 300 to 400 V is applied to the developing roller 31. The toner, which is borne on the developing roller 31 and charged positively, is transferred to the electrostatic latent image formed on the surface of the photosensitive drum 27 when the toner comes into contact with the photosensitive drum 27. That is, because the potential of the developing roller 31 is lower than the potential of the dark parts (which are at a voltage of +1000 V) and higher than the potential of the bright parts (which are at a voltage of +100V), the positively-charged toner moves selectively to the bright parts where the potential is lower. In this way, a visible image of toner is formed on the surface of the photosensitive drum 27 and development is performed.

The registration rollers 12 perform a registration operation on the sheet 3 to deliver the sheet 3 so that the front edge of the visible image formed on the surface of the rotating photosensitive drum 27 and the leading edge of the sheet 3 coincide with each other. A negative constant voltage is applied to the transfer roller 30 while the sheet 3 passes between the photosensitive drum 27 and the transfer roller 30. The negative constant voltage that is applied to the transfer roller 30 is lower than the potential of the bright part (+100 V), so the toner electrostatically clinging to the surface of the photosensitive drum 27 moves toward the transfer roller 30. However, the toner is blocked by the sheet 3 and cannot transfer to the transfer roller 30. As a result, the toner is transferred onto the sheet 3. That is, the visible image formed on the surface of the photosensitive drum 27 is transferred onto the sheet 3.

Then, the sheet 3 having the toner transferred thereon is conveyed to the fixing device 18. The heating roller 41 of the fixing device 18 applies heat of approximately 200 degrees, and the pressing roller 42 applies a pressure, to the sheet 3 with the toner image to fix the toner image permanently on the sheet 3. Note that the heating roller 41 and the pressing roller 42 are each grounded through diodes so that the surface potential of the pressing roller 42 is lower than the surface potential of the heating roller 41. Accordingly, the positively charged toner that clings to the heating roller 41 side of the sheet 3 is electrically attracted to the lower surface potential of the pressing roller 42. Therefore, the potential problem of the toner image being distorted because the toner is attracted to the heating roller 41 at the time of fixing is prevented.

The sheet delivery roller 43 delivers the sheet 3 with the fixed toner image from the fixing device 18 and conveys the sheet 3 on the sheet delivery path 44. The sheet delivery roller 45 delivers the sheet 3 to the sheet delivery tray 46 with a toner image side facing downward. Similarly, the sheet 3 to be printed next is stacked over the earlier delivered sheet 3 with a printed surface facing downward in the delivery tray 46. In this way, a user can obtain the sheets 3 aligned in the order they were printed.

To remove the paper supply cassette 6, the user can grip the handle part 180 with the user's fingers or the like between the plate surface 180*a* and the handle section 180*b* shown in FIG. 4 and pull the paper supply cassette 6 outward to replace the sheet 3 or the like. At this time, the user may accidentally grip the paper conveying path 183 formed vertically in the paper supply cassette 6 (Y direction). However, since the ridges of the guiding ribs 172 and guiding ribs 182 are rounded to form curved surfaces, there will be only a small line load if the user accidentally touches the ridges. Therefore, there is no risk of the user harming his or her fingers.

As shown in FIG. 2, the four screws 164 fixing the handle part 180 to the case unit 160 are all screwed into the screw receivers 181 following the same direction (−Z direction). Hence, all the screws can be screwed in from the same direction when assembling the paper supply cassette 6. The positions where the screws fix the handle part 180 to the case 160 incur a load when the user pulls on the handle part 180 to remove the paper supply cassette 6. However, these fixed areas are strong enough to withstand such a load because the handle part 180 is fixed by screws rather than hooks. Further, the handle part 180 is securely fixed because a plurality of screws are used. The screw holes 163 formed near the ends of both protruding ends 160*f* and 160*g* on the side wall 160*b* are separated a sufficient distance from the side wall 160*c* and side wall 160*d*. Hence, assembly of the paper supply cassette 6 can be performed smoothly without interference between the screwdriver or other tool and the side wall 160*c* and side wall 160*d*.

Generally, the separation portion 166 must be mounted into the paper supply cassette 6 with high precision. Also, the separation portion 166 must be demonstrated to have sufficient separating performance prior to shipping the product. Because the paper supply cassette 6 includes the separately-formed case unit 160, accommodating section cover 170, and handle part 180, time and effort required to redesign the separation portion 166 and once again demonstrate its separating performance can be spared. Hence, when modifications are made to the design of the laser printer 1, the case unit 160 can be used without change, since its separating performance for conveying the sheet 3 has already been demonstrated. Further, a newly designed handle part can be fixed to this case unit 160 to form the paper supply cassette. In this way, it is possible to eliminate the time and effort required to redesign the separation portion 166 and to demonstrate its separating performance.

Further, because the case unit 160 and handle part 180 are fixed by inserting screws all in a single direction, the manufacturing process can be simplified. The use of a plurality of screws to fix these components also improves the fixing strength.

Further, because components of the paper supply cassette 6 on one side of the receiving portion 160*i* are molded separately from those on the other side, the receiving portion 160*i* can be said to serve as one edge of the case unit 160. Accordingly, the mold used to form the receiving portion 160*i* can be designed with a greater degree of freedom that takes heat dissipated during the molding process into consideration. This enables forming the receiving portion 160*i* with high precision.

Since the handle part 180, case unit 160, and accommodating section cover 170 are each formed separately through injection molding, manufacturing process of these components is simplified. Also, when modifications are made to the design of the laser printer 1, only molds for the modified components need to be remanufactured. Further, since the parting lines can be set separately for each component, it is possible to set a larger draft angle to facilitate the rounding of edges and the like. Hence, production costs for the paper supply cassette 6 are less than production costs for a conventional paper supply cassette, thereby enabling a reduction in the overall production cost of the laser printer 1.

Figure 10:
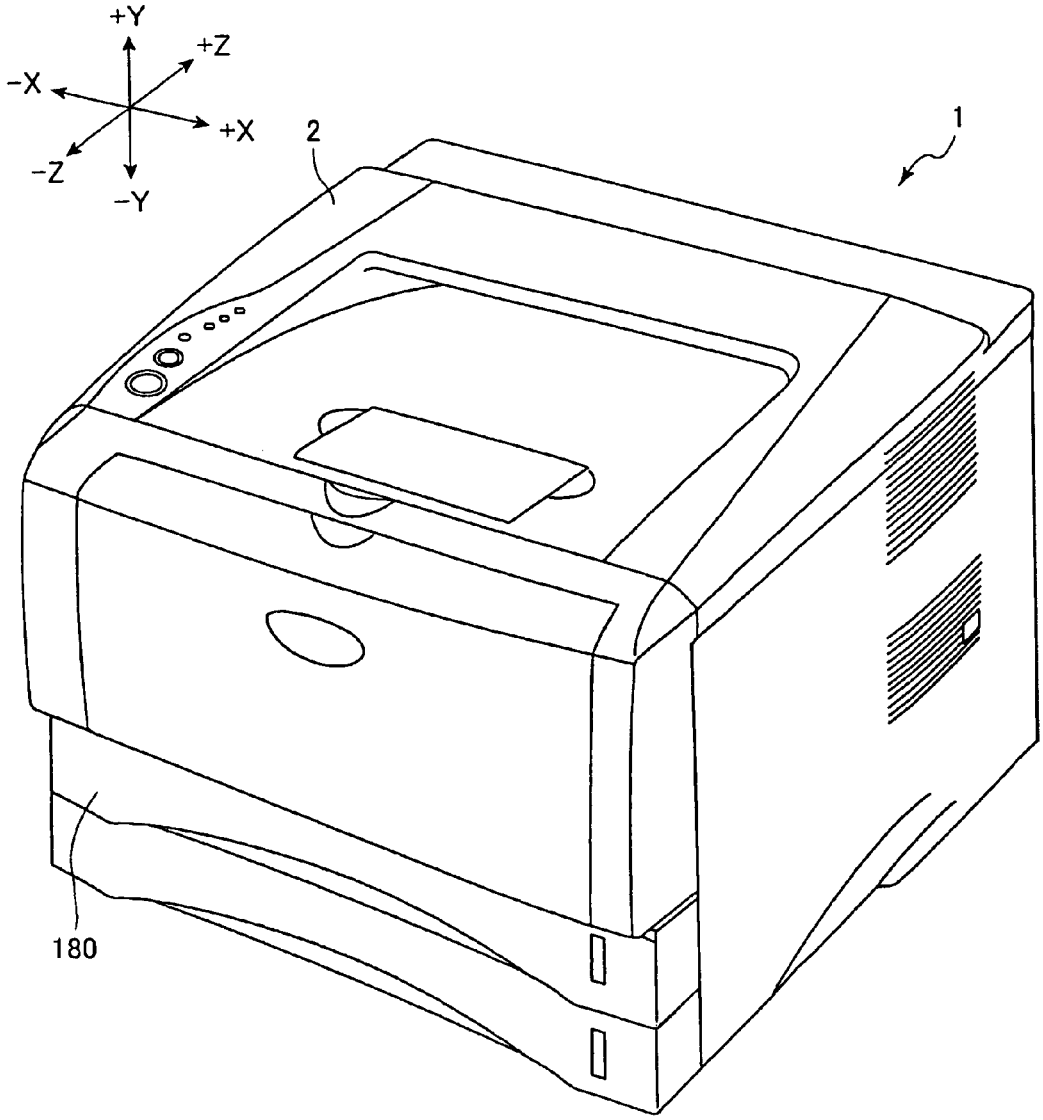
FIG. 10 is a perspective view showing the laser printer of FIG. 1.

As shown in FIG. 10, the handle part 180 has a width in X directions that is equal to or less than the width of the main casing 2. Note that the X directions are orthogonal to the mounting direction of the paper supply cassette 6. Therefore, the handle part 180 does not stick out on the left and right sides of the main casing 2. This provides a sense of unity with the design of the main casing 2.

Further, paper dust that the paper dust removing roller 202 removes from the sheet 3 accumulates in the paper dust accommodating unit formed by the accommodating section cover 170 and the side wall 160*b*. Accordingly, the limited space within the paper supply cassette 6 can be used effectively without needing to provide a separate paper dust accommodating unit. In addition, the ridges of the guiding ribs 172 and guiding ribs 182 are formed with curved surfaces and no sharp edges. Therefore, if the user accidentally grips the guiding ribs 172 or guiding ribs 182 with his or her fingers when reloading the sheet 3 in the paper supply cassette 6, for example, the guiding ribs 172 and guiding ribs 182 will not hurt the user's fingers because the design is safe.

While the invention has been described in detail with reference to specific embodiments thereof, it would be apparent to those skilled in the art that many modifications and variations may be made therein without departing from the spirit of the invention, the scope of which is defined by the attached claims.

Figure 11:
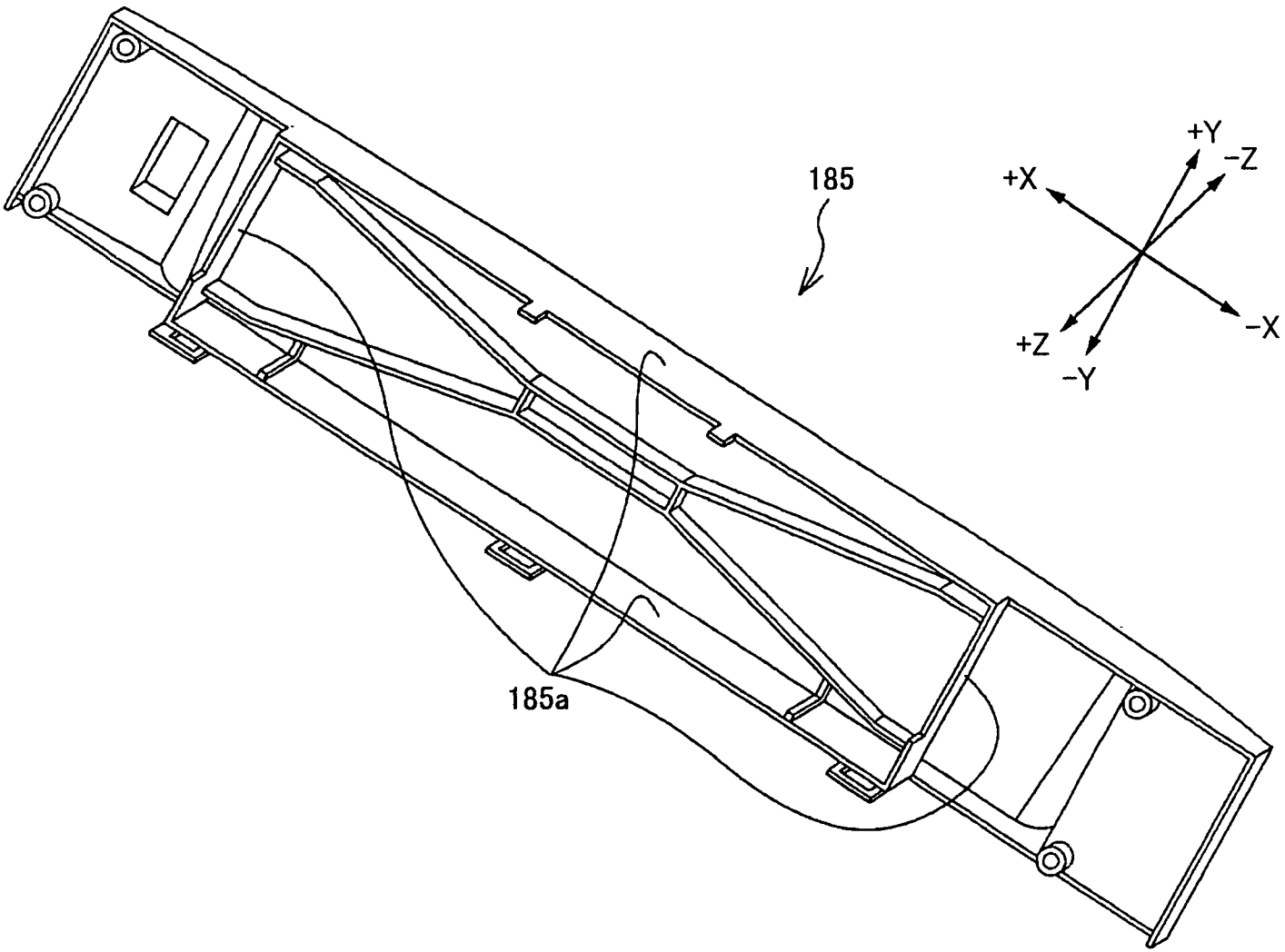
FIG. 11 is a perspective view showing a handle part according to a variation of the embodiment.

For example, a handle unit 185 shown in FIG. 11 can be fixed to the case unit 160 instead of the accommodating section cover 170 and the handle part 180. The handle unit 185 has no guide ribs. In this modification, the handle unit 185 is formed with a surface facing the −Z direction that is identical to that of the handle part 180. However, the handle unit 185 has a surface facing the +Z direction that is formed with inner wall surfaces 185*a*. The inner wall surfaces 185*a* encompass the area of the side wall 160*b* where the vibration absorbing members 165 are provided, but do not cover the protruding ends 160*f* and 160*g*. As with the handle part 180, when the handle unit 185 is fixed to the case unit 160, an enclosed space is formed by the inner wall surfaces 185*a* and the side wall 160*b*. This enclosed space functions as a paper dust accommodating unit for accumulating paper dust from the sheet 3 that is generated by friction between the sheet 3 and the rubber pad 201*a*-shown in FIG. 7.

The embodiment describes the paper supply cassette as being used in a laser printer with only a single paper supply cassette. However, the paper supply cassette according to the present invention can be used as the lower paper supply cassette in a laser printer that has two paper supply cassettes. In this way, it is possible to simplify the production process by reducing the number of parts used in assembly. In other words, because the paper conveying path 183 is formed by the handle part 180 and accommodating section cover 170, the handle part 180 and accommodating section cover 170 can be used when the paper conveying path 183 is necessary and can be easily replaced by the handle unit 185 when the paper conveying path 183 is not necessary.

Figure 12:
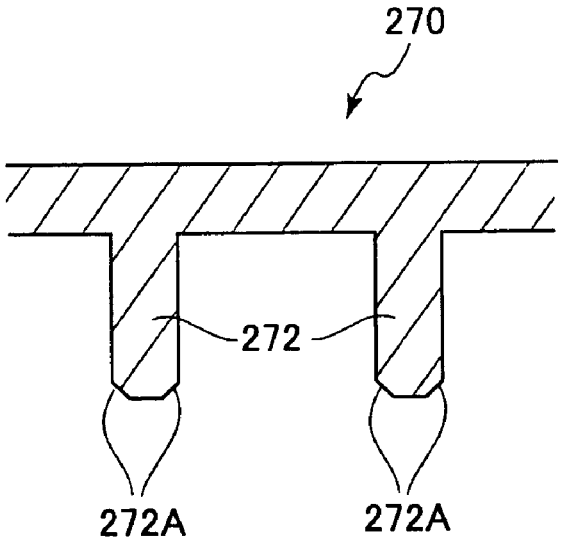
FIG. 12 is a cross-sectional view showing a modification of the guide ribs of FIG. 3.

The embodiment describes the accommodating section cover 170 formed with guiding ribs 172 that have curved ridges 172A. However, an accommodating section cover 270 shown in FIG. 12 can be provided instead. The accommodating section cover 270 is formed with guiding ribs 272 having ridges 272A that slant with respect to the direction perpendicular to the conveying direction. In other words, each ridge 272A is formed with a slanting surface that extends along the ridge 272A.

Figure 13:
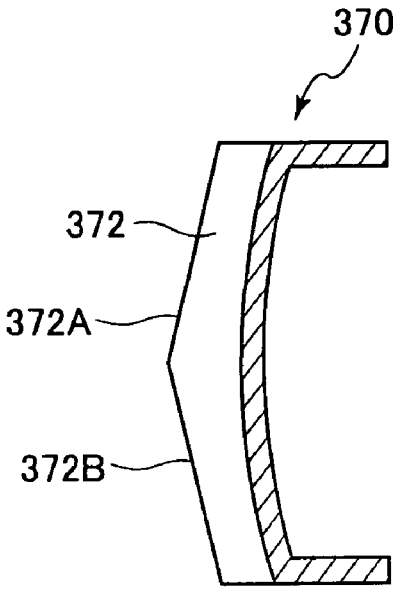
FIG. 13 is a cross-sectional view showing another modification of the guide ribs of FIG. 3.
Figure 14:
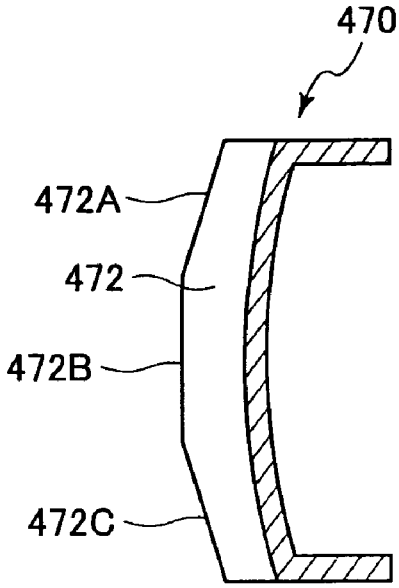
FIG. 14 is a cross-sectional view showing still another modification of the guide ribs of FIG. 3.

Also, the embodiment describes the accommodating section cover 170 formed with guiding ribs 172 that in the Z direction arch from the Y directions. However, the arch shape can be formed using flat surfaces arranged at slanting angles with respect to the Y directions. For example, as shown in FIG. 13, an accommodating section cover 370 is formed with guiding ribs 372 that include two slanting surfaces 372A and 372B instead of the smooth arc shape of the guiding ribs 172. As shown in FIG. 14, an accommodating section cover 470 is formed with guiding ribs 472 that include a flat surface 472B in its Y-direction center and two slanting surfaces 472A and 472C at either side of the flat surface 472B.

What is claimed is:

1. A sheet supply cassette, comprising:

a case that holds a stack of recording sheets, the case having:

a separation portion that separates a recording sheet from the stack of recording sheets; and a receiving portion that receives the separation portion;

a handle part provided as a separate member from the case, the handle part being fixed to the case and having a handle for pulling the case;

a dust removing unit that removes dust from the recording sheet that passes by the separation portion; and a holding unit that holds dust removed by the dust removing unit, wherein the case has a handle-part-side end that is adjacent to the handle part and the receiving portion is located at the handle-part-side end, and wherein the holding unit includes a dust holding space that holds the dust therein and that is defined between (1) an accommodating section cover as a separate member between the case and the handle part and (2) the handle-part-side end of the case.

2. The sheet supply cassette as claimed in claim 1, wherein the receiving portion includes:

a guide section guiding the separation portion in a movement direction, the separation portion being movable in the movement direction; and a support section contacting the separation portion and restricting movement in the movement direction, thereby supporting the separation portion.

3. The sheet supply cassette as claimed in claim 1, wherein the handle part defines a conveying path between the case and the handle part when the handle part is fixed to the case, so that a sheet is capable of being conveyed through the conveying path.

4. The sheet supply cassette as claimed in claim 1, wherein the dust removing unit includes:

a dust removing roller that contacts the recording sheet that passes by the separation portion and that electrostatically removes dust from the recording sheet; and a scraping member that rubs against the dust removing roller to electrostatically charge the dust removing roller and to scrape off dust clinging to the dust removing roller.

5. The sheet supply cassette as claimed in claim 1, wherein the holding unit has an inner surface that faces the dust holding space, further comprising a vibration absorbing member that is fixed to the inner surface of the holding unit.

6. The sheet supply cassette as claimed in claim 1, further comprising:

at least one fixing device that fixes the handle part to a fixing member, wherein the case has the handle-part-side end that is adjacent to the handle part and the receiving portion is located at the handle-part-side end, the at least one fixing device being inserted through the fixing member and into the handle part in a direction orthogonal both to a direction in which the recording sheets are stacked in the case and to a direction in which the handle part extends.

7. The sheet supply cassette as claimed in claim 2, wherein the movement direction has a predetermined slant angle with regard to a direction in which the recording sheets are stacked in the case.

8. The sheet supply cassette as claimed in claim 2, wherein the guide section includes a guide wall that is formed integrally with the case.

9. The sheet supply cassette as claimed in claim 2, wherein the separation portion includes:

a separating pad that applies frictional force to at least one of the recording sheets in the stack of recording sheets; and an urging member that urges the separating pad to move in the movement direction.

10. The sheet supply cassette as claimed in claim 6, wherein the case includes a fixing member that protrudes in a direction in which the handle part extends.

11. The sheet supply cassette as claimed in claim 3, wherein the handle part is capable of guiding the sheet through the conveying path.

12. The sheet supply cassette as claimed in claim 6, wherein the case has a surface being formed with ribs elongated in a direction following a conveying direction in which the sheet is conveyed through the conveying path.

13. The sheet supply cassette as claimed in claim 6, wherein the case has a handle-part-side side wall that faces toward the handle part, further comprising a guide fixed to the handle-part-side side wall, the guide being capable of guiding the sheet conveyed through the conveying path.

14. The sheet supply cassette as claimed in claim 6, wherein the fixing member protrudes in a direction in which the handle part extends.

15. The sheet supply cassette as claimed in claim 6, wherein the at least one fixing device comprises at least one screw.

16. The sheet supply cassette as claimed in claim 13, wherein the guide has a handle-part-side surface and the handle part has a guide-side surface, the handle-part-side surface of the guide and the guide-side surface of the handle part facing each other, each of the handle-part-side surface and the guide-side surface being formed with ribs elongated in a direction following a conveying direction in which the recording sheet is conveyed through the conveying path.

17. The sheet supply cassette as claimed in claim 14, wherein the handle part, the case, and the guide are each formed separately by injection molding.

18. The sheet supply cassette as claimed in claim 10, further comprising at least one fixing device that fixes the handle part to the fixing member, the at least one fixing device being inserted through the fixing member and into the handle part in a direction orthogonal both to a direction in which the recording sheets are stacked in the case and to a direction in which the handle part extends.

19. The sheet supply cassette as claimed in claim 11, wherein the handle part has a surface being formed with ribs elongated in a direction following a conveying direction in which the sheet is conveyed through the conveying path.

20. The sheet supply cassette as claimed in claim 14, wherein the at least one fixing device includes fixing devices inserted in the same direction with each other through the fixing member and into the handle part.

21. The sheet supply cassette as claimed in claim 16, wherein each rib includes a ridge that extends in the conveying direction, each ridge being formed with a curving surface that extends along the ridge.

22. The sheet supply cassette as claimed in claim 16, wherein each rib includes a ridge that extends in the conveying direction, each ridge being formed with a slanting surface that extends along the ridge.

23. The sheet supply cassette as claimed in claim 18, wherein the at least one fixing device includes two fixing devices inserted in the same direction with each other through the fixing members and into the handle part.

24. The sheet supply cassette as claimed in claim 19, wherein each rib includes a ridge that extends in the conveying direction, each ridge being formed with a curving surface that extends along the ridge.

25. The sheet supply cassette as claimed in claim 24, wherein each rib includes a ridge that extends in the conveying direction, each ridge being formed with a slanting surface that extends along the ridge.

26. The sheet supply cassette as claimed in claim 18, wherein the at least one fixing device comprises at least one screw.

27. An image forming device, comprising:

a main casing;

an image forming section located in the main casing;

a sheet supply cassette detachably mounted in the main casing below the image forming section, the sheet supply cassette including:

a case that holds a stack of recording sheets; and a handle part provided as a separate member from the case, the handle part being fixed to the case and having a handle;

a lower sheet supply cassette that is disposed below the sheet supply cassette, the lower sheet supply cassette conveying sheets one at a time; and a separating roller;

a dust removing unit that removes dust from the recording sheets conveyed by the separating roller; and a holding unit that holds the dust removed by the dust removing unit, the holding unit being defined between (1) an accommodating section cover as a separate member between the case and the handle part and (2) a handle-part-side of the case, wherein the handle part defines a conveying path between the case and the handle part when the handle part is fixed to the case, so that a sheet is capable of being conveyed through the conveying path from the lower sheet supply cassette to the image forming section.

28. The image forming device as claimed in claim 27, wherein the sheet supply cassette is removable from the main casing by being pulled in a pulling direction.

29. The image forming device as claimed in claim 27, wherein the case includes:

a separation portion that separates a recording sheet from the stack of recording sheets; and a receiving portion that receives the separation portion, and wherein the separating roller separates the stacked recording sheets one sheet at a time in cooperation with the separation portion and conveys the separated recording sheets one at a time.

30. The sheet supply cassette as claimed in claim 27, wherein the handle part is capable of guiding the sheet through the conveying path from the lower sheet supply cassette to the image forming section.

31. The image forming device as claimed in claim 28, wherein the case of the sheet supply cassette includes two side walls and positioning parts, each side wall extending in the pulling direction and having a side wall surface that faces the main casing, each positioning part extending in the pulling direction, at least one of the positioning parts being formed on the side wall surface of each side wall.

32. The image forming device as claimed in claim 28, wherein the handle part has a width in a width direction orthogonal to the pulling direction and the main casing has a width in the width direction, the width of the handle part being equal to or less than the width of the main casing.

33. The image forming device as claimed in claim 28, wherein the case includes a fixing member that protrudes in a direction orthogonal both to a direction in which the recording sheets are stacked in the case and to the pulling direction.

34. The sheet supply cassette as claimed in claim 30, wherein the handle part has a surface being formed with ribs elongated in a direction following a conveying direction in which the sheet is conveyed through the conveying path.

35. The image forming device as claimed in claim 33, further comprising at least one fixing device that fixes the handle part to the fixing member, the at least one fixing device being inserted through the fixing member and into the handle part in a direction parallel to the pulling direction.

36. The sheet supply cassette as claimed in claim 34, wherein each rib includes a ridge that extends in the conveying direction, each ridge being formed with a curving surface that extends along the ridge.

37. The sheet supply cassette as claimed in claim 34, wherein each rib includes a ridge that extends in the conveying direction, each ridge being formed with a slanting surface that extends along the ridge.

38. The sheet supply cassette as claimed in claim 35, wherein the at least one fixing device comprises at least one screw.

* * * * *